United States Patent [19]

Luperti et al.

[11] Patent Number: 4,805,891

[45] Date of Patent: Feb. 21, 1989

[54] STANDARD AND REVERSE COLLATOR

[75] Inventors: Harry E. Luperti, Wilton; Robert Irvine, Riverside; Anthony Luvara, Stamford, all of Conn.

[73] Assignee: Pitney Bowes Inc., Stamford, Conn.

[21] Appl. No.: 140,695

[22] Filed: Jan. 4, 1988

[51] Int. Cl.[4] ..... B65H 39/10

[52] U.S. Cl. ..... 271/212; 271/220

[58] Field of Search ..... 271/3.1, 212, 245, 246, 271/220, 223, 224

[56] References Cited

U.S. PATENT DOCUMENTS 4,502,805 3/1985 Humbs ..... 271/212 X
4,640,506 2/1987 Luperti et al. ..... 271/212

FOREIGN PATENT DOCUMENTS 977953 12/1964 United Kingdom ..... 271/212

*Primary Examiner*—Richard A. Schacher
*Attorney, Agent, or Firm*—Lawrence E. Sklar; David E. Pitchenik; Melvin J. Scolnick

[57] ABSTRACT

A reversible collating machine for stacking sheets of paper being fed seriatim thereto from a singulating feeder in the same or reverse order as the sheets appear in the singulating feeder. The reversible collating machine includes a housing, apparatus secured to the housing for rotatably mounting endless, elastic belts, at least one upper, endless, elastic belt rotatably mounted to the mounting apparatus, and at least one lower, endless, elastic belt rotatably mounted to the mounting apparatus. Each of the belts includes an upper and a lower reach, the lower reach of the upper belt being situated slightly above the upper reach of the lower belt to thereby frictionally engage and transport the sheets of paper. The collating machine further includes a frame slidably mounted to the housing, the frame being movable between an upstream and a downstream position, an upper ramp guide block secured to the frame, and a lower ramp guide block secured to the frame. The lower block has an L-shaped downstream portion, whereby when the frame is located in the upstream position collation in one of the two orders is effected and when the frame is located in the downstream position the other of the two orders is effected.

5 Claims, 5 Drawing Sheets

14
22
24
26
28
30
32
33
34
36
38
40
42
44
46
52
60
62
64
66
68
80
82
84
86
88
92
94
100
106
108

STANDARD AND REVERSE COLLATOR

BACKGROUND OF THE INVENTION

The instant invention relates to a collating machine and more particularly to a collating machine having the dual capability of stacking sheets of paper in the same or reverse order in which they are fed to the collating machine.

Collating machines are frequently used in line with other paper handling equipment as a means of assembling a plurality of sheets of paper into a particular, desired packet prior to further processing, which may include additional collating, folding and inserting. For further background, reference can be made to U.S. Pat. Nos. 2,766,569 and 4,143,98. In a typical paper handling sequence involving an initial output consisting of a plurality of sheets of paper, to be later combined with subsequent output from other sheet feeding devices situated downstream, the initial output is fed from a stack seriatim to the collator, which collates the output into the desired packets, either in the same order as the sheets had when they were in the stack upstream of the collator or the reverse order. Each packet may then be folded, stitched or subsequently combined with other output from document feeding devices located downstream thereof and ultimately inserted into a mailing envelope.

In many cases it happens that the initial output to be collated arrives in an opposite order from that desired for downstream processing so that the collator needs to collate in an opposite manner to enable the documents to emerge from the collator in the proper sequence for subsequent handling. In such a case, one option is to have a second line of paper handling equipment which includes a collator having reverse collating capability. Clearly, this is not a desirable option to users of paper handling equipment. An improvement over the second line option is offered in U.S. Pat. No. 4,640,506 issued Feb. 3, 1987 to the assignee of the instant application which teaches the incorporation in the collating machine of removable reverse order stacking devices. However, incorporating and removing machine parts require time and effort which can be very costly for complex equipment which can afford little down time. Accordingly, the instant invention provides not a removable device, but rather simply a movable device in a collating machine which is easily moved by an operator from one position to another to change from regular sequence stacking to reverse sequence stacking. Movement of the movable device can be effected by a machine operator in less than a few seconds' time, and in most cases should require no more than one second of an operator's time.

SUMMARY OF THE INVENTION

In accordance with the foregoing, the instant invention provides a reversible collating machine for stacking sheets of paper being fed seriatim thereto from a singulating feeder in the same or reverse order as said sheets appear in said singulating feeder. The reversible collating machines comprises a housing, means secured to said housing for rotatably mounting endless, elastic belts, at least one upper, endless, elastic belt rotatably mounted to said mounting means, and at least one lower, endless, elastic belt rotatably mounted to said mounting means. Each of said belts includes an upper and a lower reach, the lower reach of the upper belt being situated slightly above the upper reach of the lower belt to thereby frictionally engage and transport the sheets of paper. The collating machine further comprises a frame slidably mounted to the housing, the frame being movable between an upstream and a downstream position, an upper ramp guide block secured to the frame, and a lower ramp guide block secured to the frame. The lower block has an L-shaped downstream portion, whereby when the frame is located in the upstream position collation in one of said two orders is effected and when the frame is located in the downstream position the other of said two orders is effected.

DESCRIPTION OF THE PREFERRED EMBODIMENT

Figure 1:
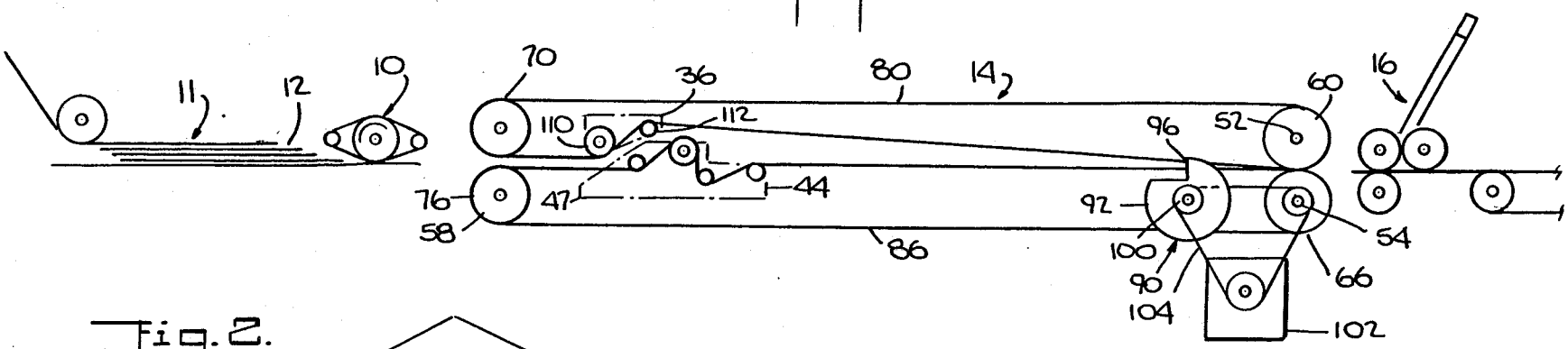
FIG. 1 is a side elevational view of an in-line collating machine in accordance with the instant invention together with a singulating feeder and a buckle chute folding machine.
Figure 10:
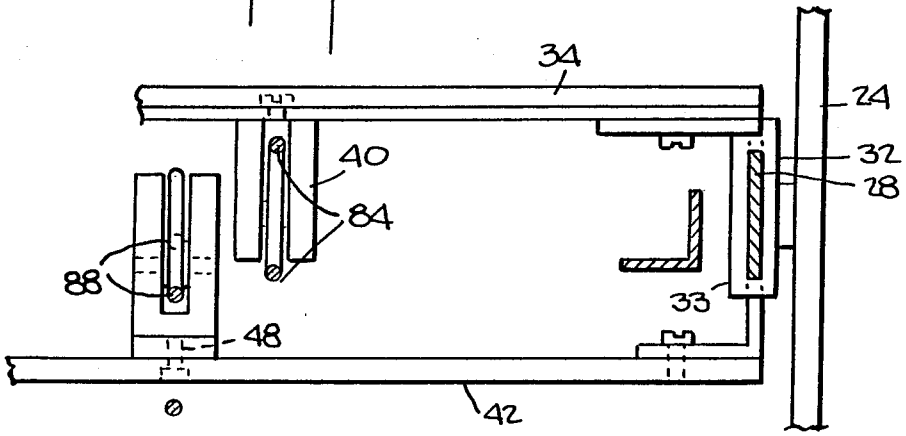
FIG. 10 is a sectional view taken on the plane indicated by the line 10—10 in FIG. 5.
Figure 2:
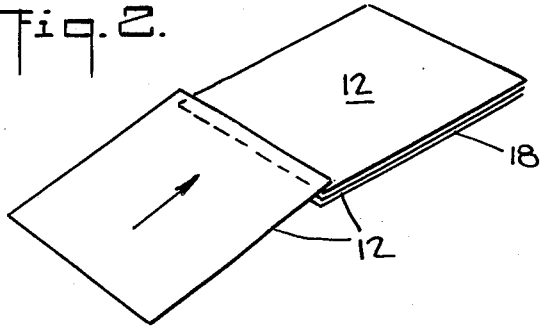
FIG. 2 is a perspective view showing a stack of paper sheets being collated in order by the collating machine seen in FIG. 1.
Figure 3:
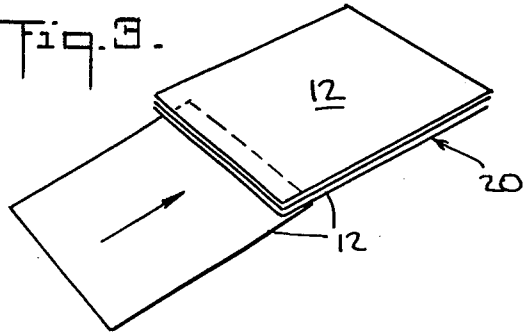
FIG. 3 is the same as FIG. 2 except that the stack of paper sheets is being collated in reverse order.
Figure 9:
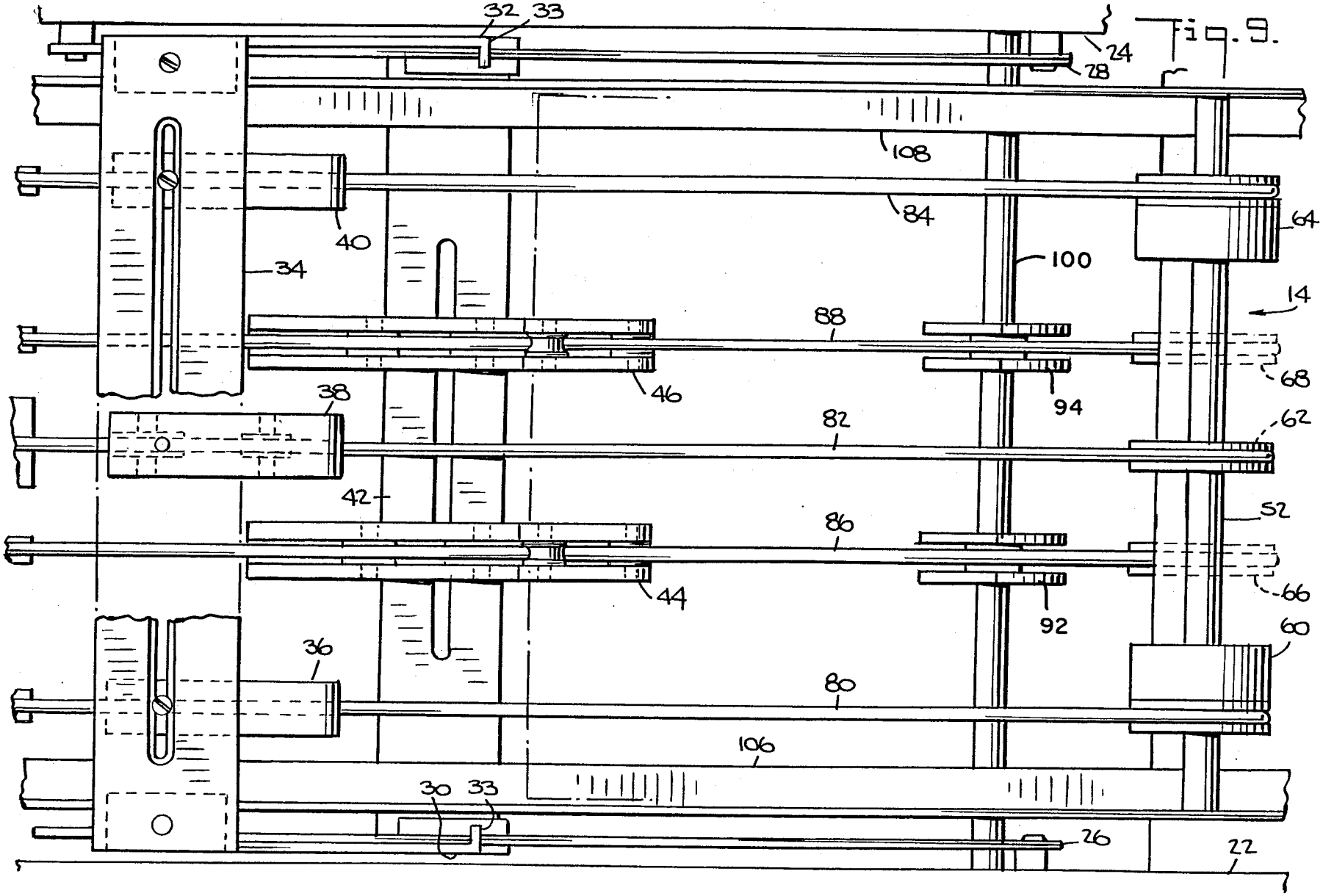
FIG. 9 is a top plan view of the collating machine seen in FIG. 4.

In describing the preferred embodiment of the instant invention, reference is made to the drawings wherein there is seen in FIG. 1 a singulating feeder 10 for conveying a supply stack 11 of sheets 12 seriatim to a collating machine generally designated 14 and finally to a folding machine generally designated 16. The collating machine 14 is capable of accumulating a plurality of sheets 12 in order as shown in FIG. 2, i.e. the bottom sheet 12 in the supply stack 11 would also be the bottom sheet in the accumulated stack 18 seen in FIGS. 2 and 6. Also, the collating machine 14 is capable of accumulating a plurality of sheets 12 in reverse order as shown in FIG. 3, i.e. the bottom sheet 12 in the supply stack 11 would be the top sheet 12 in the accumulated stack 20 seen in FIGS. 3 and 7. This is accomplished by means of suitable, cooperating, conveying apparatus within the collating machine 14. The conveying apparatus is situated between a pair of housing panels 22 and 24 (see FIGS. 4 and 9) and includes a pair of beams 26 and 28 secured to the panels 22 and 24 respectively. Slidably mounted on the beams 26 and 28 respectively are a pair of brackets 30 and 32 between which an upper mounting arm 34 is transversely secured. The brackets 30 and 32 include flanges 33 which have apertures 35 therein for slidably receiving the beams 26 and 28.

Three upper ramp guide blocks 36, 38 and 40 are fixedly secured to the mounting arm 34. Extending from the lower portions of the brackets 30 and 32 transversely thereof is a lower mounting arm 42 on which a pair of lower ramp guide blocks 44 and 46 are mounted. The blocks 44 and 46 are slidable transversely owing to bolts 48 which are slidably mounted in a channel 50 which traverses the arm 42. The lower guide blocks 44 and 46 include a lower inclined end 47 on the upstream side for intercepting a leading end of the sheets 12 as they are individually conveyed through the collating machine 14 after having been separated by the upstream singulating feeder 10. The arms 34 and 42 together with the brackets 30 and 32 comprise a slidable frame generally designated 57 (see FIG. 4).

As best seen in FIGS. 5–8 a pair of driven shafts 52 and 54 and a pair of idler shafts 56 and 58 are suitably journalled in the panels 22 and 24. Three pulleys 60, 62 and 64 are operatively connected to the driven shaft 52 while two pulleys 66 and 68 are operatively connected to the driven shaft 54. Likewise, three pulleys 70, 72 and 74 are operatively connected to the idler shaft 56 while two pulleys 76 and 78 are operatively connected to the idler shaft 58. A suitable, upper, endless, elastic conveyor belt 80 is suspended on the pulleys 60 and 70, a second suitable, upper, endless, elastic conveyor belt 82 is suspended on the pulleys 62 and 72, while a third suitable, upper, endless, elastic conveyor belt 84 is suspended on the pulleys 64 and 74. Similarly, a suitable, lower, endless elastic conveyor belt 86 is suspended over the pulleys 66 and 76 while a second, suitable, lower, endless, elastic conveyor belt 88 is suspended on the pulleys 68 and 78.

Figure 7:
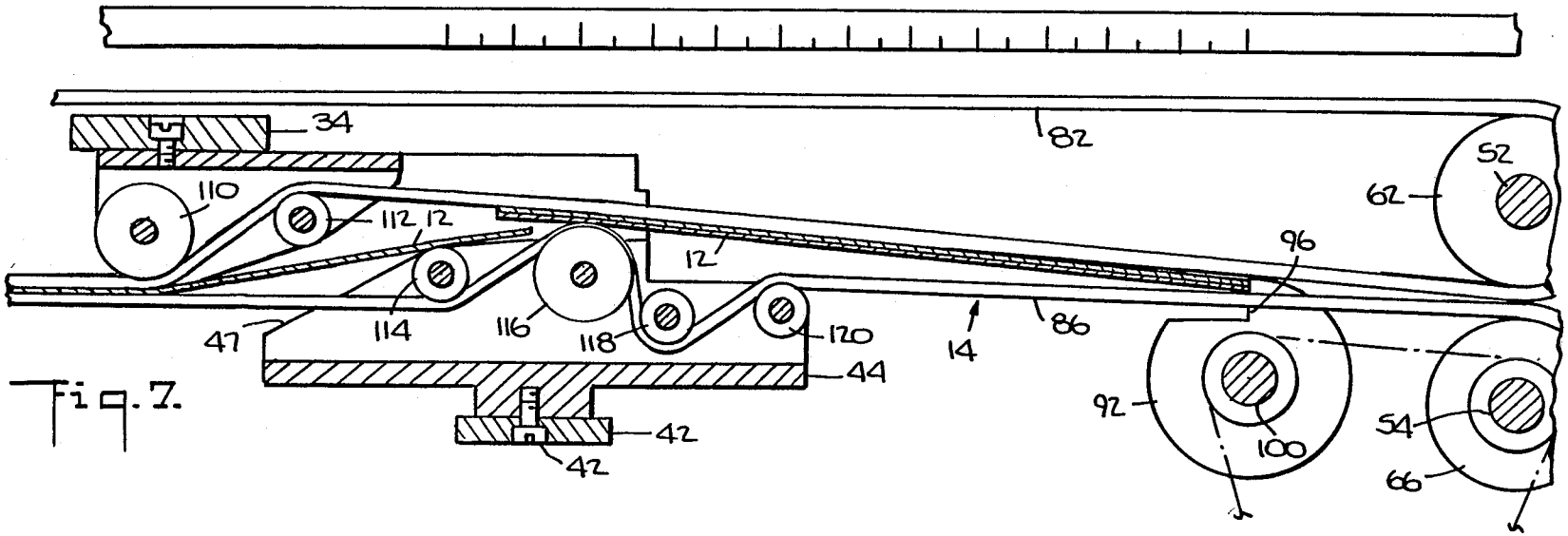
FIG. 7 is the same as FIG. 6 except that the sheets are shown being stacked in reverse order.
Figure 8:
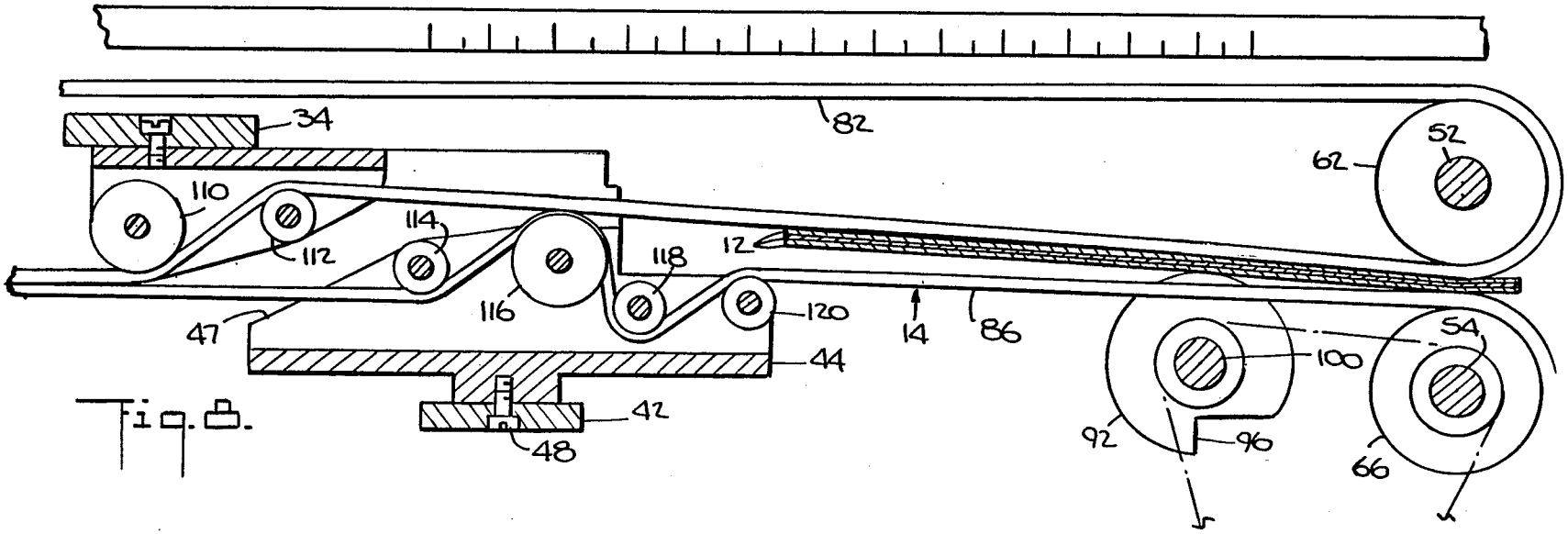
FIG. 8 is the same as FIG. 7 except that the collated sheets are being advanced downstream from the collating machine.

There is a cyclable registration device 90 (see FIG. 1) consisting of disks 92 and 94 each of which includes a vertical face 96 and 98 respectively. The disks 92 and 94 are fixedly secured to a shaft 100 rotatably mounted in the panels 22 and 24. There is a motor 102 (see FIG. 1) which is provided with a drive member 104 which in turn appropriately engages the shafts 54 and 100 in order to drive the pulleys 66 and 68 and the disks 92 and 94. As seen in FIGS. 1, 7 and 8, an electromagnetic clutch 105 is provided to activate the disks 92 and 94 at appropriate times.

A pair of paper guides 106 and 108 are secured to the panels 22 and 24 respectively for guiding the sheets 12 through the collating machine 14. For additional guidance of the sheets 12, each of the upper guide blocks 36, 38 and 40 includes a pair of suitably journalled idler rollers 110 and 112 and each of the lower guide blocks 44 and 46 includes four suitably journalled idler rollers 114, 116, 118 and 120, as best seen in FIGS. 5–8. The idler rollers 110 and 112 provide and define the appropriate path for the upper belts 80, 82 and 84 while the four idler rollers 114, 116, 118 and 120 provide and define the appropriate path for the lower belts 86 and 88. The construction of the belts 80, 82, 84, 86 and 88 are of an "0" ring nature, but it is possible to utilize a flat belt, as long as the belt material is elastic, or there is provided an adequate belt tensioning system, the likes of which are well known by those skilled in the art.

Figure 4:
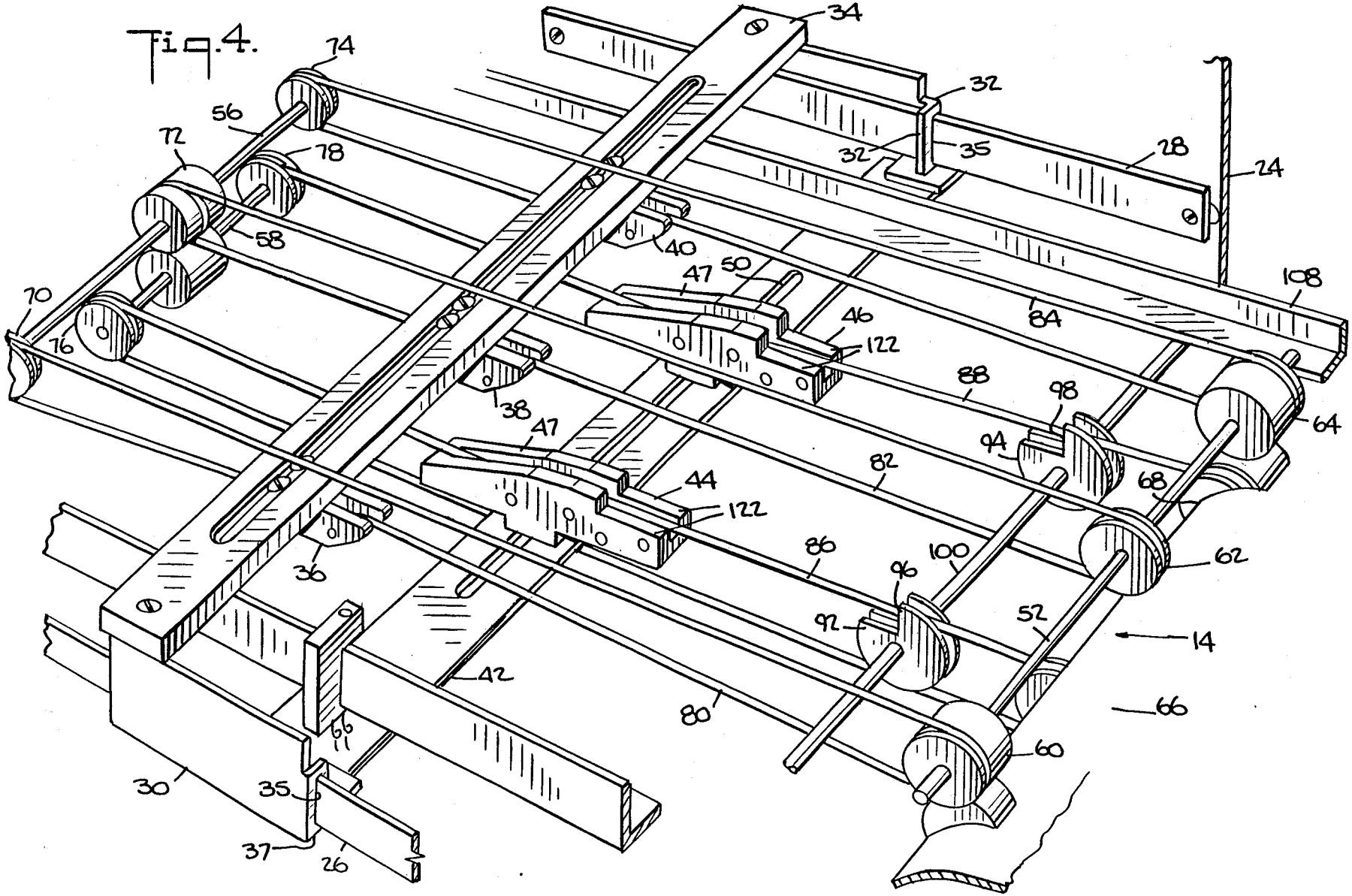
FIG. 4 is a perspective view of the collating machine seen in FIG. 1.

The lower guide blocks 44 and 46 are seen to include an L-shaped downstream portion defined by horizontal support surfaces 122 and vertical abutment surfaces 124 (see FIG. 4). It should be noted that the rollers 116 and 118 are so arranged that the conveyor belts 86 and 88 are maintained remote from the surfaces 122 and 124.

Figure 5:
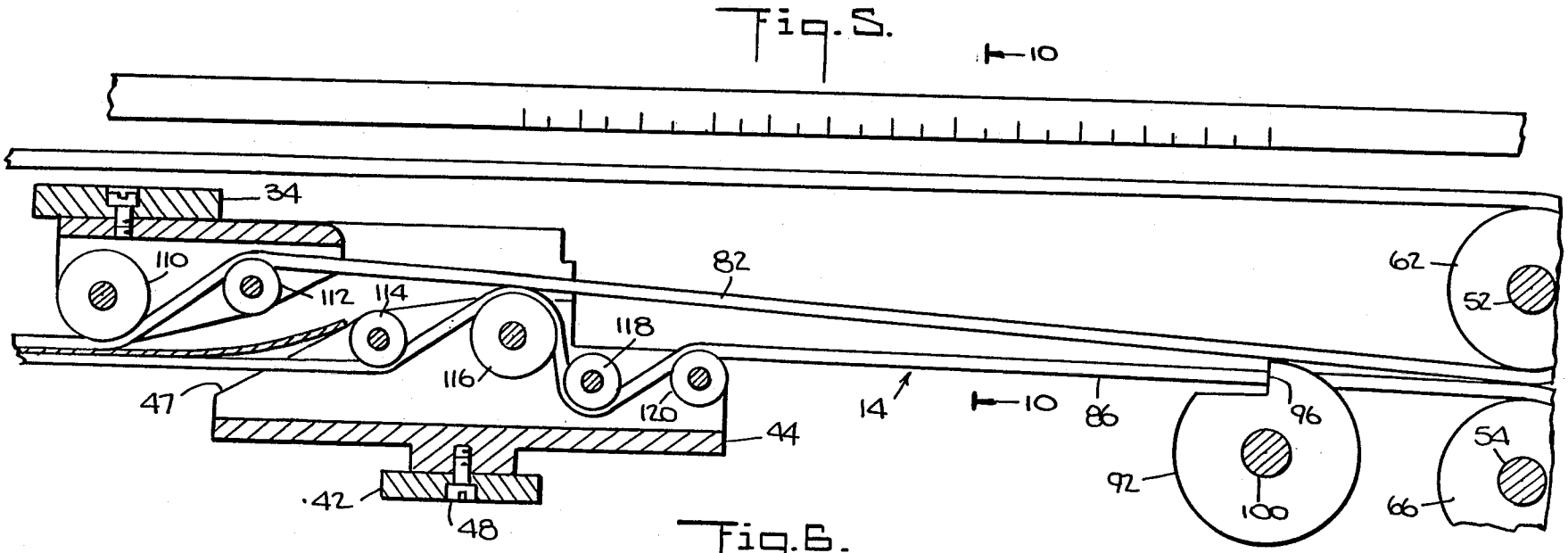
FIG. 5 is a vertical sectional view of the collating machine seen in FIG. 4 arranged to collate sheets in the same order as when they were stacked in the singulating feeder.
Figure 6:
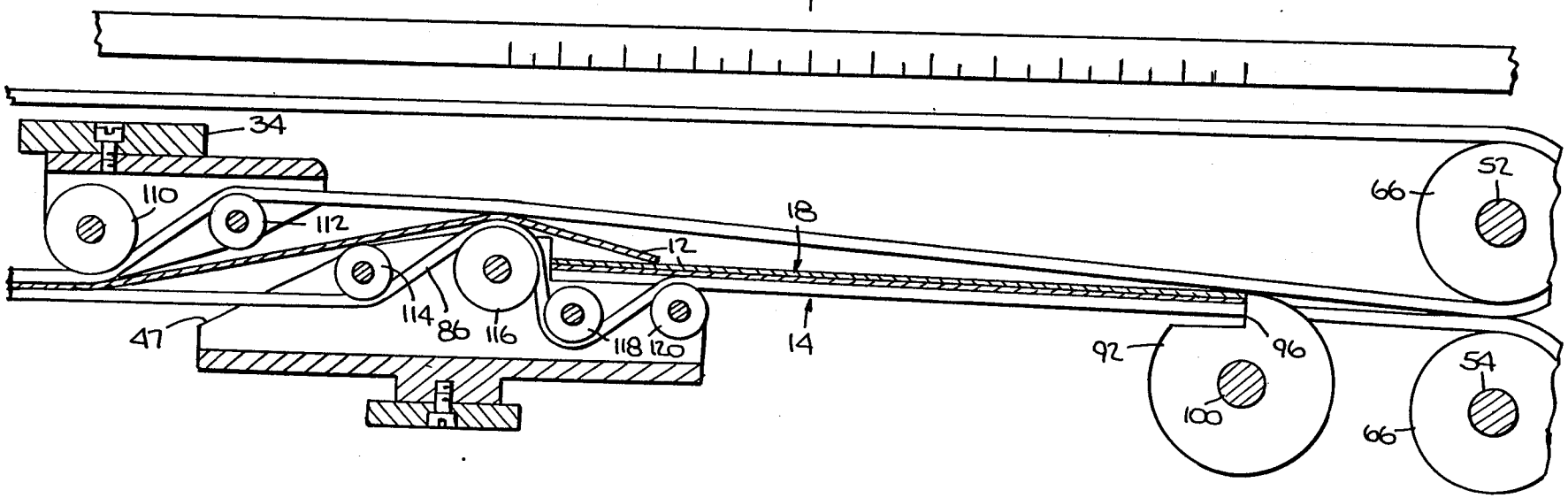
FIG. 6 is the same as FIG. 5 except that the sheets are shown being stacked in the collating machine.

Having explained the details of the apparatus hereinabove, the two modes of operation will now be explained. In order to effect stacking of the sheets 12 in the same order as they appear in the supply stack 11 at the singulating feeder 10, as seen in FIG. 2, the upper mounting arm 34 is manually translated to a relatively upstream position, depending upon the length of the sheets 12, as seen in FIGS. 5 and 6. Movement of the arm 34 effects movement of the upper ramp guide blocks 36, 38 and 40, as well as the lower ramp guide blocks 44 and 46, since the upper blocks 36, 38 and 40 are fixedly secured to the arm 34 and the lower blocks 44 and 46 are secured to the lower mounting arm 42 which is secured to the brackets 30 and 32 which in turn are secured to the upper mounting arm 34. Translation of the arm 34 is possible because the brackets 30 and 32 which are secured to the arm 34 are slidably mounted on the beams 26 and 28 respectively. As best seen in FIG. 6, the lower blocks 44 and 46 are situated so that there is sufficient room between the vertical faces 96 and 98 of the registration disks 92 and 94 respectively and the vertical abutment surfaces 124 of the blocks 44 and 46 to accommodate the sheets 12 being fully laid out in a substantially horizontal plane. The result of this spacing of the lower blocks 44 and 46 with respect to the registration disks 92 and 94 is that each succeeding sheet 12 is deposited on top of the preceding sheet 12, resulting in a stack 18 having sheets 12 therein appearing in the same order as in the supply stack 11, since the sheets 12 are advanced one at a time from the bottom of the supply stack 11. The stack 18 comes to rest against the vertical faces 96 and 98 of the registration disks 92 and 94 respectively, as shown in FIG. 6.

When the collating machine 14 has accumulated the required number of sheets 12 in the registered position at the cyclable registration device 90, a predetermined electronic control device (not shown) provides power to the electromagnetic clutch 105 which then rotatably engages the shaft 100 having the disks 92 and 94 mounted coaxially therewith. The clutch 105 is rotatably coupled to the drive member 104 and the stack 18 is then advanced along a path downstream to a folding machine 16, or other appropriate apparatus, for subsequent operations.

In order to effect stacking of the sheets 12 in the reverse order as they appear in the supply stack 11 at the singulating feeder 10, as seen in FIG. 3, the upper mounting arm 34 is manually translated to a relatively downstream position, depending upon the length of the sheets 12, as seen in FIGS. 7 and 8. As best seen in FIG. 7, the lower blocks 44 and 46 are situated so that the trailing end of each sheet 12 is elevated with respect to the leading end; i.e. the trailing end of the sheets 12 is caused to rest across the top of the blocks 44 and 46, which results in each succeeding sheet 12 being inserted beneath each preceding sheet 12 and effecting a stack 20 having sheets 12 therein appearing in the reverse order as in the supply stack 11, since the sheets 12 are advanced on at a time from the bottom of the supply stack 11. As seen in FIG. 7, the stack 20 comes to rest against the vertical faces 96 and 98 of the registration disks 92 and 94 respectively. Once the required number of sheets 12 has been accumulated at the registration disks 92 and 94, the clutch 105 is enabled and causes the stack 20 to be advanced downstream, as seen in FIG. 8, for further processing.

From the foregoing description, it is clear that the instant invention provides a movable ramp guide block system which can be easily adjusted by the operator in order to effect regular order or reverse order collating from a stack of supply sheets.

Therefore, having briefly described an embodiment of the present invention which enables a machine operator to convert a collating machine from a mode where sheets are collated in one order to an alternate mode where the sheets may be collated in a reverse order, it will be evident that changes to the machine described herein will only enhance the present invention which is captured in the spirit and scope of the following claims.

What is claimed is:

1. A reversible collating machine for stacking sheets of paper fed seriatim thereto from a singulating feeder in the same or reverse order as said sheets appear in said singulating feeder, comprising:

a housing;

means secured to said housing for rotatably mounting endless, elastic belts;

at least one upper, endless, elastic belt rotatably mounted to said mounting means;

at least one lower, endless, elastic belt rotatably mounted to said mounting means, each of said belts having an upper and a lower reach, wherein the lower reach of the upper belt is situated slightly above the upper reach of the lower belt to thereby frictionally engage and transport said sheets of paper;

a frame slidably mounted to said housing, said frame being movable between an upstream and a downstream position;

an upper ramp guide block secured to said frame; and a lower ramp guide block secured to said frame, said lower block having a L-shaped downstream portion, whereby when said frame is located in said upstream position collation in one of said two orders is effected and when said frame is located in said downstream position the other of said two orders is effected.

2. The collating machine of claim 1, wherein said mounting means comprises a plurality of shafts rotatably mounted in said housing and a plurality of pulleys secured to said shafts for rotatably mounting said endless, elastic belts.

3. The collating machine of claim 2, wherein said belts comprise 0-ring belts.

4. The collating machine of claim 3, wherein said frame comprises a pair of brackets slidably mounted to said housing, an upper mounting arm secured at each end to said pair of brackets and a lower mounting arm secured at each end to said pair of brackets.

5. The collating machine of claim 4, wherein said housing includes a pair of beams for slidably receiving said pair of brackets.

* * * * *